US006701890B1

(12) United States Patent
Suhre et al.

(10) Patent No.: US 6,701,890 B1
(45) Date of Patent: Mar. 9, 2004

(54) METHOD FOR CONTROLLING THROTTLE AIR VELOCITY DURING THROTTLE POSITION CHANGES

(75) Inventors: Blake R. Suhre, Neenah, WI (US); Robert E. Haddad, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 204 days.

(21) Appl. No.: 10/011,924

(22) Filed: Dec. 6, 2001

(51) Int. Cl.[7] ..... F02D 9/00
(52) U.S. Cl. ..... 123/350; 123/399
(58) Field of Search ..... 123/399, 361, 123/403, 350; 73/118.2

(56) References Cited

U.S. PATENT DOCUMENTS

| | | | | |
|---|---|---|---|---|
| 4,231,383 A | * | 11/1980 | Eversole et al. | 137/1 |
| 4,524,744 A | | 6/1985 | Adams | 123/459 |
| 4,574,760 A | | 3/1986 | Jones et al. | 123/472 |
| 5,040,505 A | | 8/1991 | Toyoda | 123/327 |
| 5,239,966 A | | 8/1993 | Yamagata et al. | 123/493 |
| 5,595,159 A | * | 1/1997 | Huber et al. | 123/362 |
| 5,707,560 A | | 1/1998 | Nevin | 261/44 |
| 5,848,582 A | | 12/1998 | Ehlers et al. | 123/486 |
| 6,099,367 A | * | 8/2000 | White et al. | 440/5 |
| 6,119,653 A | | 9/2000 | Morikami | 123/339 |
| 6,250,292 B1 | | 6/2001 | Suhre | 123/688 |
| 6,298,824 B1 | | 10/2001 | Suhre | 123/406 |
| 6,520,167 B1 | * | 2/2003 | Kanno | 123/674 |

FOREIGN PATENT DOCUMENTS

| | | | |
|---|---|---|---|
| DE | 3837321 | * 10/1990 | F02D/9/02 |

* cited by examiner

*Primary Examiner*—Mahmoud Gimie
*Assistant Examiner*—Hai Huynh
(74) *Attorney, Agent, or Firm*—William D. Lanyi

(57) ABSTRACT

An engine control system calculates air velocity through a throttle body as a function of mass air flow through the throttle body, air density, and the effective area of air flow through the throttle body as a function of throttle plate position. Mass air flow is calculated as a function of the effective area through the throttle body, barometric pressure, manifold pressure, manifold temperature, the ideal gas constant, and the ratio of specific heats for air. By controlling the throttle plate position as a dual function of throttle demand, which is a manual input, and air velocity through the throttle body, certain disadvantages transient behavior of the engine can be avoided.

25 Claims, 5 Drawing Sheets

METHOD FOR CONTROLLING THROTTLE AIR VELOCITY DURING THROTTLE POSITION CHANGES

BACKGROUND OF THE INVENTION

1. Field of the Invention

The present invention is generally related to a throttle position control method and, more particularly, to a method for controlling the throttle position as a function of both a manually provided throttle demand signal and the air velocity flowing through a throttle body region.

2. Description of the Prior Art

Many different types of engine control methods are well known to those skilled in the art. It is common to use a microprocessor, as an engine control unit, in order to control the engine as a function of various monitored parameters, such as manifold pressure, barometric pressure, and temperature.

U.S. Pat. No. 6,298,824, which issued to Suhre on Oct. 9, 2001, discloses an engine control system using an air and fuel control strategy based on torque demand. The control system for a fuel injected engine provides an engine control unit that receives signals from a throttle handle that is manually manipulated by an operator of a marine vessel. The engine control unit also measures engine speed and various other parameters, such as manifold absolute pressure, temperature, barometric pressure, and throttle position. The engine control unit controls the timing of fuel injectors and the injection system and also controls the position of a throttle plate. No direct connection is provided between a manually manipulated throttle handle and the throttle plate. All operating parameters are either calculated as a function of ambient conditions or determined by selecting parameters by matrices which allow the engine control unit to set the operating parameters as a function of engine speed and torque demand as represented by the position of the throttle handle.

U.S. Pat. No. 6,250,292, which issued to Suhre on Jun. 26, 2001, discloses a method of controlling an engine with a pseudo throttle position sensor value. In the event that the throttle sensor fails, a method is provided which allows a pseudo throttle position sensor value to be calculated as a function of volumetric efficiency, pressure, volume, temperature, and the ideal gas constant. This is accomplished by first determining an air per cylinder (APC) value and then calculating the mass air flow into the engine as a function of the air per cylinder value. The mass air flow is then used, as a ratio of the maximum air flow at maximum power at sea level for the engine, to calculate a pseudo throttle position sensor value. That pseudo throttle position sensor value is then used to select an air/fuel target ratio that allows the control system to calculate the fuel per cycle (FPC) for the engine.

U.S. Pat. No. 5,848,582, which issued to Ehlers et al on Dec. 15, 1998, discloses an internal combustion engine with barometric pressure related start of air compensation for a fuel injector. A control system for a fuel injector system for an internal combustion engine is provided with a method by which the magnitude of the start of air point for the injector system is modified according to the barometric pressure measured in a region surrounding the engine. This offset, or modification, of the start of air point adjusts the timing of the fuel injector system to suit different altitudes at which the engine may be operating.

U.S. patent application Ser. No. 09/882,700 which was filed on Jun. 15, 2001, by Suhre et al, discloses a method and apparatus for determining the air charge mass for an internal combustion engine. The engine and apparatus are provided for calculating the air charge mass for an engine as a function of four measured parameters. These parameters include the engine speed measured by a tachometer, a throttle position measured by a throttle position sensor, a manifold air temperature, and a barometric pressure. Without the need for a mass air flow sensor or a manifold absolute pressure sensor, the present invention provides a system for quickly and accurately calculating the air charge mass for the engine.

U.S. Pat. No. 6,119,653, which issued to Morikami on Sep. 19, 2000, describes an engine running control apparatus for an outboard motor. The apparatus includes a full-closure state detecting device for outputting a full-closure detection signal when the throttle valve is in the fully closed state, a control device for controlling the open degree of the air control valve, a time-measuring device for counting up to a predetermined period of time in response to the full-closure detection signal, an air speed detecting device for detecting the rotating speed of the engine and an initial value setting device for setting up an engine speed at which control of the degree of the opening is started by the control valve, in response to a full-closure detection signal. In this configuration, the control device, in response to the reception of the full-closure detecting signal, fixes the opening of the air control valve until the time-measuring device counts up to a predetermined period of time, and controls the opening of the air control valve after the elapse of the predetermined time so that the engine speed will be reduced at a predetermined rate over time.

U.S. Pat. No. 5,040,505, which issued to Toyoda on Aug. 20, 1991, describes an intaking rate control device of internal combustion engine. The method and apparatus for controlling the air intake rate of an internal combustion engine, including a deceleration control system responsive to actuation of an idle switch during deceleration for bypassing an intake throttle valve and feeding bypass air into the engine is disclosed. The control device actuates the deceleration control system only when the cooling water temperature of the engine is greater than or equal to a predetermined water temperature, the engine is decelerating, the engine speed is less than or equal to an actuation speed associated with the deceleration control system, and the engine speed is changing at a rate which is greater than or equal to an actuation differential change rate associated with the deceleration control system. The control device applies to the deceleration control system a control signal having a duty ratio which corresponds to the change rate of the engine speed and which increases the rate at which bypass air is taken into the engine.

U.S. Pat. No. 5,239,966, which issued to Yamagata et al on Aug. 31, 1993, describes an electronic control fuel injection apparatus for two cycle engine. The fuel injection apparatus for a crank chamber compression type 2-cycle engine which compensates a fuel injection amount predetermined by an opening degree of an engine intake air system and an engine speed in response to a fuel amount reduction rate allocated by using an opening degree of the engine intake air system and an engine speed if the engine speed enters an acceleration loss region during a predetermined deceleration and or re-acceleration of the engine while a deceleration of the engine is detected.

U.S. Pat. No. 4,524,744, which issued to Adams on Jun. 25, 1985, describes a fuel system for a combustion engine. A fuel injection apparatus in which a closed fuel circuit is pressurized, and the amount of fuel injected is determined by the pressure in the circuit. Air intake by the engine is controlled in response to the amount of fuel injected. The fuel injection apparatus includes a reservoir with a fixed level of fuel, and a high pressure pump pumps fuel from the reservoir and into the fuel circuit. Fixed orifice injection nozzles communicate with the circuit so fuel is varied only by the pressure. Pressure in the circuit is varied by a valve that releases fuel into the reservoir to lower the pressure in the circuit, the valve being controlled by the conventional accelerator pedal. Air to the engine is modulated in response to fuel flow. This is accomplished by varying an air valve in accordance with pressure in the fuel circuit, or by using a constant velocity valve which would vary the engine demand. The apparatus further includes an auxiliary chamber receivable in the spark plug hole to convert the engine to a stratified charge engine. The fuel is injected into the auxiliary chamber, and passes from the auxiliary chamber into the cylinder so the cylinder receives a lean mixture. The auxiliary chamber includes a spark plug to ignite the rich mixture, and the chamber acts as a torch to ignite the lean mixture in the cylinder.

U.S. Pat. No. 4,574,760, which issued to Jones et al on Mar. 11, 1986, describes a fuel injection throttle body. A fuel injection system of the single point, throttle body type in which a fuel injector is located centrally above the inlet to an air throttling body that contains a variable venturi consisting of a plug and nozzle assembly wherein the plug includes a fuel dispersion plate directing the fuel towards a movable nozzle together defining a convergent-divergent flow air that is variable in area in response to the dynamic pressure of the air against it at higher air flows or alternately responsive to the suction of the engine at low air flows to be moved to a position providing essentially a constant air velocity flowing past the fuel under all conditions of operation to shear the fuel and thereby atomize the same for an economical and efficient operation of the engine.

U.S. Pat. No. 5,707,560, which issued to Nevin on Jan. 13, 1998, describes a constant velocity carburetor with variable venturi slide having bleed holes at an oblique angle and method of operation. A variable Venturi slide includes a beveled edge at an oblique angle to lower surface of the slide and air flow, and an auxiliary hole having an opening on the beveled edge communicating between the air flow and the interior of the variable Venturi slide. By being located on the beveled edge, the opening of the auxiliary hole is effectively kept out of the high velocity low air pressure air stream at low air velocities during partial throttle conditions. The auxiliary hole bleeds vacuum from the interior of the variable Venturi slide, picked up by the other lift hole located on the bottom of the slide, and slows the slide lift rate. The slide stays down or rises very slowly under conditions in which a conventional prior art slide would be starting to rise at a linear rate. At higher air velocities, when the throttle plate is opened quickly or operated at near wide open conditions, the opening of the auxiliary hole adds a vacuum to the interior of the slide, and increases the slide lift rate. In such manner, the lift rate of the slide is reduced at lower air pressure and velocity, while at the same time, the lift rate of the slide is increased at higher air pressure and velocity. The resulting non-linear lift rate keeps the fuel mixture lean under partial throttle conditions when driving conditions require it, yet provides a ratio of air to fuel mixture that represents the optimum value for the prevailing conditions of engine speed and load throughout a broad range, thereby effecting an improvement in fuel economy and reducing the emission of pollutants.

The patents described above are hereby expressly incorporated by reference in the description of the present invention.

In any internal combustion engine using a mechanical or electronic throttle system, it is possible to open the throttle fast enough to cause the air velocity in the intake manifold to drop momentarily to an undesirably small value. This low value of air velocity, passing through the throttle body, has a detrimental affect on fuel distribution and can promote increased wetting of the walls in the region of the throttle body and intake manifold. Conversely, the throttle can also be closed too quickly for proper transient fuel control. In this latter case, it is desirable to keep the manifold air velocity below a certain upper limit.

Certain carburetors, which are known to those skilled in the art, are constant velocity type carburetors which control air velocity with a mechanical means via the use of a diaphragm controlled plunger throttling valve. These types of constant velocity (CV) carburetors are in common use on certain motorcycles and are said to improve throttle response when compared to non-constant velocity carburetors. The Suzuki Corporation, on several models of motorcycles, utilizes a twin throttle mechanism. The primary throttle is mechanically actuated and connected to the handlebar twist grip by a cable. The secondary throttle is controlled electronically and can be used to limit the effective opening rate of the primary throttle. This arrangement generally allows the two throttles to keep throttle air velocity above some lower limit. However, this type of twin throttle mechanism does not always maintain the air velocity below an upper limit.

It would therefore be significantly beneficial if a control system could be provided for an internal combustion engine which controls the physical position of a throttle plate, in the throttle body structure, as a dual function of both a manually provided throttle control signal and the velocity of air passing through the throttle body. It would also be significantly beneficial if the velocity passing through a throttle could be maintained between an upper and lower velocity limit under all conditions, even when sudden changes are requested by the operator of the internal combustion engine.

SUMMARY OF THE INVENTION

A method for controlling the operation of an engine, made in accordance with the present invention, comprises the steps of receiving a throttle command signal and determining a commanded throttle position as a function of the manually caused throttle command signal. The present invention further comprises the steps of determining a mass air flow through a preselected portion of an air intake conduit of the engine and determining a density of air passing through the preselected portion of the air intake conduit of the engine. The present invention comprises the steps of determining an effective area of the preselected portion of the air intake conduit and also determining an air flow velocity through the preselected portion of the air intake conduit. In a particularly preferred embodiment of the present invention, the preselected portion of the air intake conduit is the throttle body and air conducting regions nearby. The present invention further comprises the steps of comparing the air flow velocity to an acceptable range of velocities and providing an amended throttle command signal in response to the air flow velocity not being within the acceptable range of velocities. In other words, if the commanded throttle position causes the air flow velocity through the throttle body region to fall outside an acceptable velocity range, the commanded throttle position is replaced by an amended throttle command signal in order to cause the air velocity to change sufficiently to be within the acceptable range.

In certain embodiments of the present invention, the commanded throttle position is a percentage of full travel of the throttle relative to a throttle body structure. The mass air flow determining step can comprise the step of measuring the mass air flow directly with the mass air flow sensor or, alternatively, it can comprise the step of calculating the mass air flow as a function of barometric pressure, manifold pressure, temperature, and effective area of the preselected portion of the air intake conduit. The air density determining step can comprise the steps of measuring a temperature at the throttle body, measuring a pressure at the throttle body, and calculating the air density as a function of pressure and temperature.

The present invention can further comprise the step of determining the effective area by selecting the effective area from a table of a plurality of magnitudes of effective areas stored as a function of an associated plurality of throttle positions. The use of a look-up table of this type simplifies the procedure of rapidly determining an effective throttle area as a function of the angular position, expressed as a percentage of full travel, of the throttle plate within the throttle body structure. The airflow velocity determining step of the present invention can comprise the step of calculating the air flow velocity as a function of the mass air flow through the throttle body, the density of air passing through the throttle body, and the temperature of air within the air manifold of the engine. The throttle command signal receiving step of the present invention can comprise the step of receiving a signal which represents the position of a manually movable throttle control handle.

More simply stated, the method of controlling the operation of an engine, in accordance with the present invention, comprises the steps of receiving a throttle command signal and causing a throttle plate to move to a position determined as the dual function of both the throttle command position and an air velocity through the throttle body.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
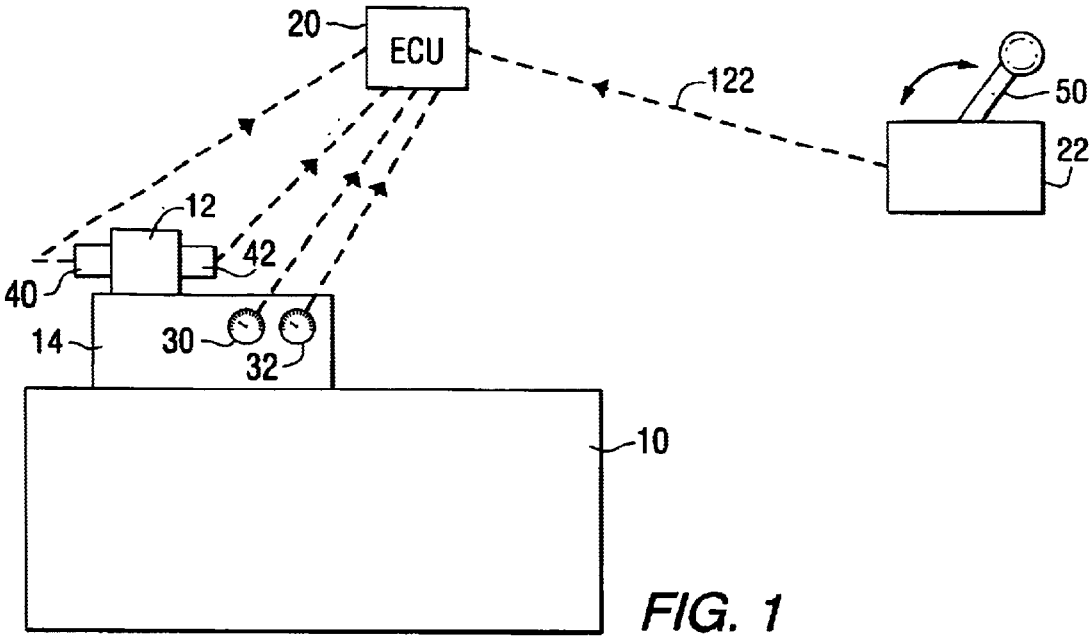
FIG. 1 is a highly schematic representation of an engine, a throttle body, an engine control unit, and a manually controllable throttle handle.

Throughout the description of the preferred embodiment of the present invention, like components will be identified by like reference numerals.

FIG. 1 is a highly schematic illustration of an internal combustion engine 10 which is provided with a throttle body 12 that regulates the flow of air through an air intake manifold 14 and into the cylinders of the engine 10. Also shown in FIG. 1 is an engine control unit 20 and a throttle handle mechanism 22 which is manually movable to allow the operator of a marine vessel to control the engine 10.

The engine control unit 20 receives signals from a temperature measuring device 30 and a pressure measuring device 32. In some applications, more than one pressure sensing device 32 can be used in order to provide signals to the engine control unit 20 relating to both manifold pressure and barometric pressure also, either of the representations of the sensors, 30 or 32, could be associated with a mass air flow sensor in certain embodiments. The engine control unit 20 can receive signals from a throttle position sensor 40 which allows the engine control unit 20 to determine the angular position of a throttle plate within the throttle body mechanism 12. In some applications, the engine control unit 20 can control the position of the throttle plate within the throttle body mechanism 12 by providing signals to a DC servomotor 42.

The method for controlling the operation of the engine 10, in accordance with the present invention, relates to the procedural steps performed by the engine control unit 20 to move the throttle plate within the throttle body 12 by providing signals to the DC servomotor 42. The commanded position of the throttle plate is determined by the ECU 20 as a dual function of both the position of the throttle handle 50 and the velocity of air flowing through the throttle body 12. As a result, the throttle plate position within the throttle body 12 is not always the same position requested by the operator of the marine vessel, as represented by the position of the throttle handle 50 relative to the throttle handle mechanism 22. The command provided to the DC servomotor 42 is determined as a dual function of the position of the throttle handle 50 in combination with the velocity flowing through the throttle body 12. In other words, the engine control unit 20 assures that the air velocity flowing through the throttle body 12 and related components, such as the air intake manifold 14, is within certain upper and lower limits.

Figure 2A:
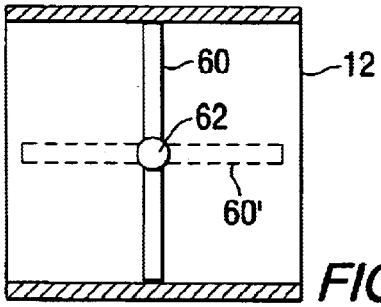
FIGS. 2A–2C show various section views of a throttle body.

FIG. 2A is a section view of a throttle body structure 12 with a throttle plate 60 being rotatably attached within the throttle body 12 to rotate about a pivot shaft 62. The throttle plate 60 can rotate about the pivot shaft 62 from the fully closed position, represented by the solid line representation of the throttle plate 60, to a fully opened position, represented by the dashed line version of the throttle plate 60'. As is well known to those skilled in the art, the fully closed position of the throttle plate 60 does not necessarily reach the position shown in FIG. 2A, where the throttle plate is perfectly perpendicular to the internal walls of the throttle body 12. Instead, the throttle plate 60 typically reaches a fully closed position prior to perfect perpendicularity with the walls. Also, as is well known to those skilled in the art, the fully open position of the throttle plate 60' need not attain a position where the throttle plate 60' is perfectly parallel to the flow of air through the throttle body 12, as shown in FIG. 2A.

Figure 2B:
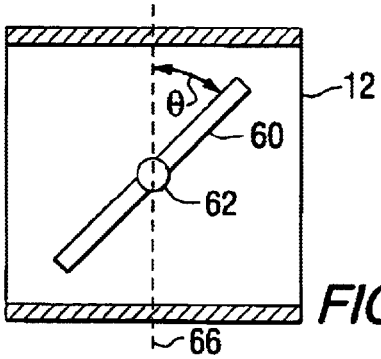

FIG. 2B shows the throttle body 12 with the throttle plate 60 rotated by an angle θ relative to a dashed line 66 that is perfectly perpendicular to the internal walls of the throttle body 12. When the throttle plate 60 is rotated in the manner shown in FIG. 2B, an effective area is created through which air can flow past the throttle plate 60 and through the internal cylindrical opening of the throttle body 12.

Figure 2C:
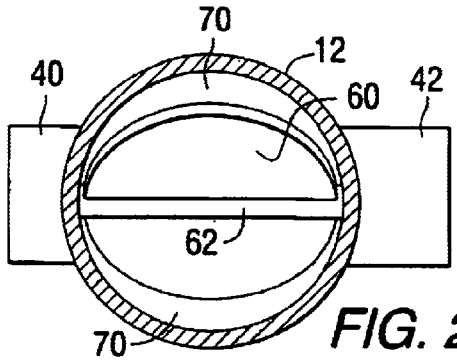

FIG. 2C is an end view of the illustration in FIG. 2B. The throttle plate 60 is rotated about the pivot shaft 62 to create an effective area 70 shown in FIG. 2C above and below the tilted throttle plate 60.

Figure 3:
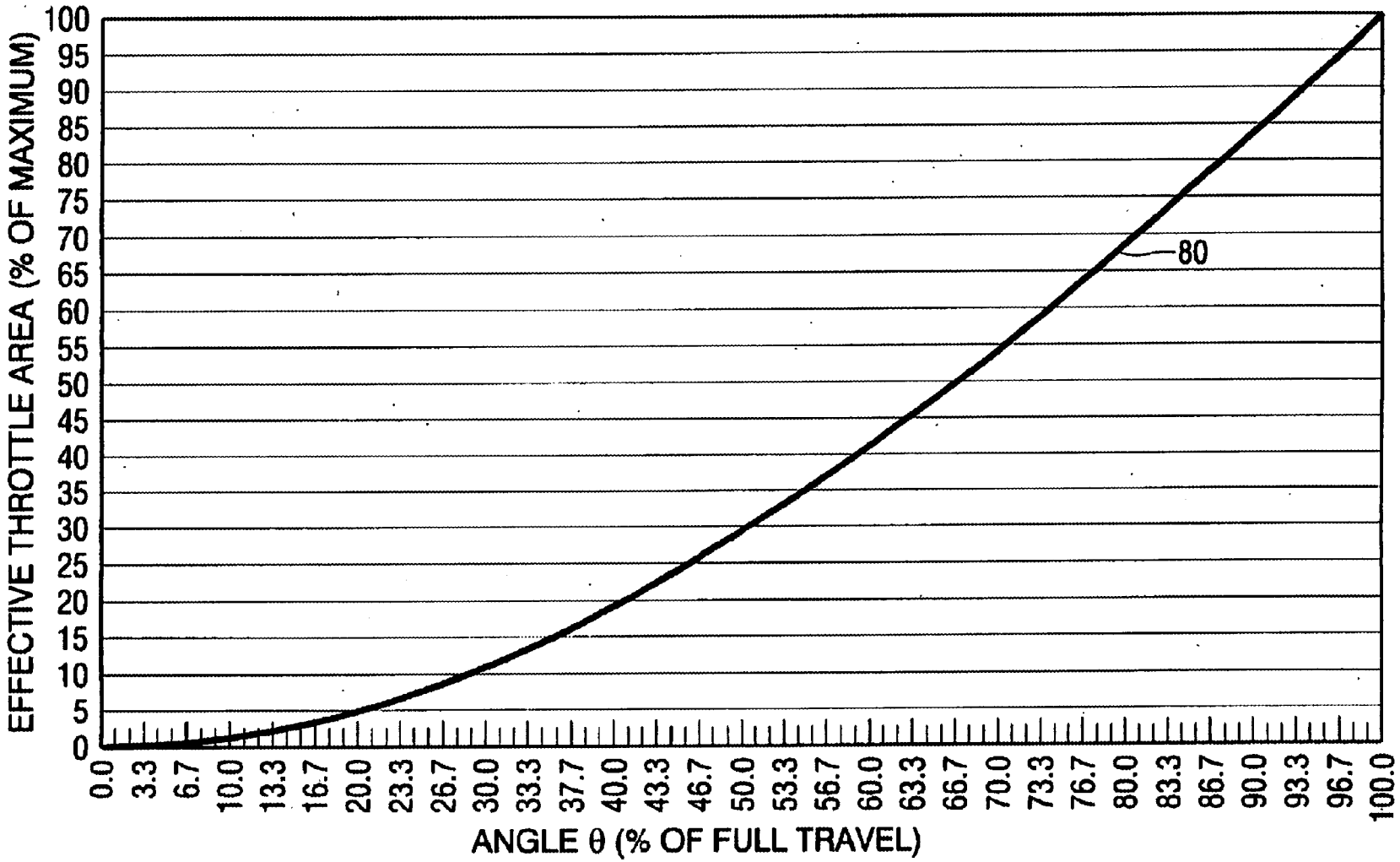
FIG. 3 is a graphical representation of the relationship between effective throttle area and throttle plate position.

With reference to FIGS. 2B, 2C, and 3 the effective area 70 through which air can flow through the throttle body 12, as a function of the angle of the throttle plate 60, is graphically represented in FIG. 3. The angle θ is represented in FIG. 3 as a percentage of its maximum travel from the fully closed position to the fully opened position and the effective throttle area 70 is shown in FIG. 3 as a percentage of its maximum magnitude when the throttle plate 60 is in a fully open position. As can be seen, line 80 in FIG. 80 is nonlinear. As will be discussed in greater detail below, the present invention uses the effective area 70 in certain calculations. The magnitude of the effective area 70 can either be dynamically calculated as a function of angle θ and the diameters of the throttle plate 60 and throttle body 12 or, alternatively, these relative magnitudes can be calculated and stored in a look-up table of a microprocessor, such as the engine control unit 20, for a prescribed number of individual throttle positions. A microprocessor can then quickly refer to the look-up table in order to determine a previously calculated effective area 70 as a function of the throttle plate angle θ.

Figure 4:
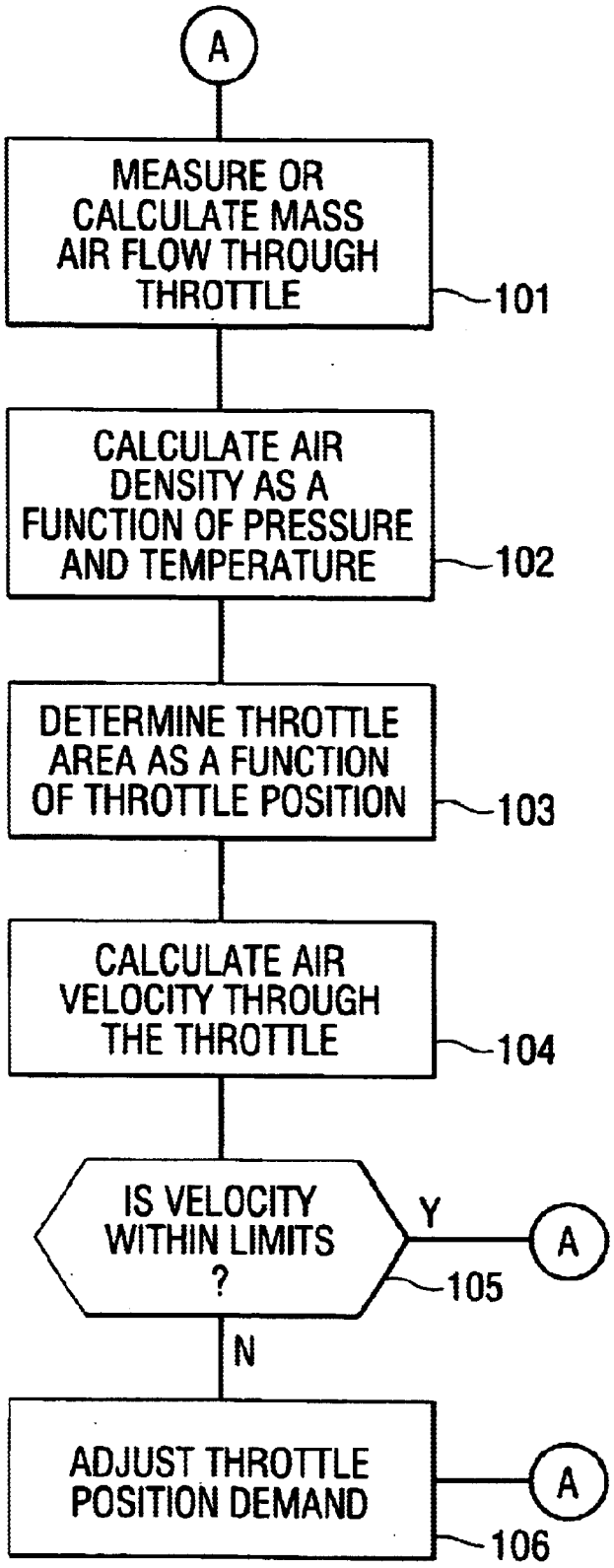
FIG. 4 is a simplified flow chart of the steps performed by the present invention.

The method of the present invention is represented in FIG. 4 as a highly simplified flow chart. The purpose of FIG. 4 is to show the basic steps of the method of the present invention for controlling the operation of an engine. These control steps will be described in greater detail with reference to the control diagram of FIG. 5.

In FIG. 4, the mass air flow through the throttle body 12 is measured or calculated. In applications where the mass air flow is measured, various types of mass air flow sensors or hot wire anemometers can be used to directly measure the mass air flow through the throttle body structure 12. Alternatively, the mass air flow can be calculated as a function of the effective throttle area 70, the barometric pressure, the manifold temperature, the ideal gas constant, the manifold pressure, and the ratio of specific heats which is the ratio of the specific heat for air at constant pressure to the specific heat for air at constant volume.

After calculating or measuring the mass air flow through the throttle body, as represented by functional block 101 in FIG. 4, the air density is calculated as a function of pressure and temperature as shown in functional block 102. Then, the throttle effective area is determined as a function of throttle position at functional block 103 and the air velocity through the throttle body 12 is calculated at functional block 104. The specific order in which functional blocks 101–104 are performed is not limiting to the present invention but, instead, can be performed in any order that is convenient and appropriate for the particular system using the method of the present invention.

At functional block 105, the calculated air velocity through the throttle body 12 is compared to an allowed range which can be defined by upper and lower limits. If the velocity is within the allowed range, the algorithm represented in FIG. 4 returns to the starting point and functional blocks 101–104 are performed again. On the other hand, if the velocity is not within the prescribed limits or range, as determined by functional block 105, the throttle position demand is amended at functional block 106. Then, the program returns to the starting point A to repeat the process. Not shown in FIG. 4 is the receipt of a throttle command from the operator of the marine vessel. As will be described in greater detail below, the manually controlled movement of the throttle handle, such as is identified by reference numeral 50 in the discussion associated with FIG. 1, provides a throttle command that can be followed by the engine control unit in positioning the throttle plate 60 or, alternatively, this command can be amended by the engine control unit when the air velocity through the throttle body 12 is not within an acceptable range.

Figure 5:
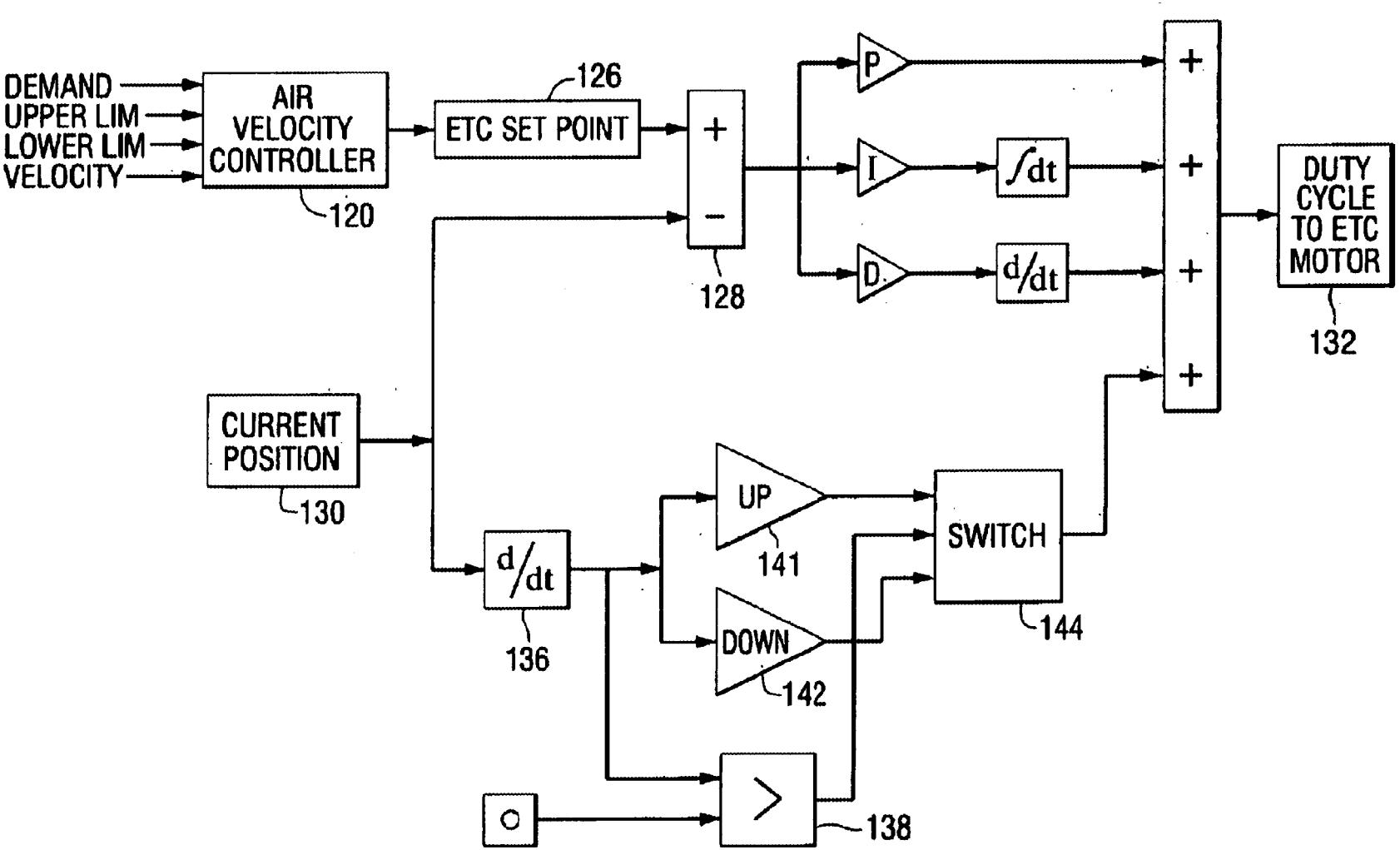
FIG. 5 is a control diagram of the steps performed by the present invention.

In FIG. 5 an air velocity controller 120 receives a demand, such as that represented by dashed line 122 in FIG. 1, from a manually controllable throttle handle 50. It also receives a predetermined upper and lower limit for air velocity through the throttle body 12. The air velocity controller 120 is also provided with the actual calculated velocity of air travelling through the throttle body 12. The air velocity controller 120 then provides a total demand signal, which is the electronic throttle control setpoint 126 to a comparitor 128. The electronic throttle control setpoint 126 is compared to the current throttle position 130 by the comparitor 128. A PID controller provides a signal which serves as the duty cycle demand to the electronic throttle control motor 132. The duty cycle command to the electronic throttle control motor 132 is the result of a proportional-integral-differential (PID) control procedure as represented symbolically in FIG. 5.

With continued reference to FIG. 5, the current position 130 is also used by the present invention to determine a change in the current position as a function of time. This is represented by block 136 in FIG. 5. This comparison, in combination with block 138, determines whether or not the current position 130 is less than or greater than the desired position. In conjunction with these calculations and comparisons, the up and down selections, 141 and 142, are provided to the switch 144 that also provides a signal to the PID controller which determines the appropriate duty cycle for the electronic throttle control motor.

As is well known to those skilled in the art, the mass air flow rate, as a function of time, can be defined as a function of the charge air density $\rho_{chg}$, the air velocity through the throttle body $V_{th}$, and the effective throttle area $A_{th}$ as defined in equation 1 below.

$$dm_{th}/dt=\rho_{chg}V_{th}A_{th} \quad 1$$

The charge air density $\rho_{chg}$ can be defined as a function of manifold pressure $P_{man}$, the ideal gas constant R, and the manifold temperature $T_{man}$ as shown in equation 2 below.

$$\rho_{chg}=P_{man}/RT_{man} \quad 2$$

Equations 1 and 2 can be used to derive the relationship shown below as equation 3 which defines the velocity $V_{th}$ through the throttle body as a function of mass air flow, air density $\rho_{chg}$, and effective throttle area $A_{th}$. Therefore, if the variables on the right side of equation 3 are known, the velocity through the throttle body can be calculated.

$$V_{th}=(dm_{th}/dt)/\rho_{chg}A_{th} \quad 3$$

The mass air flow through the throttle body can either be measured by a mass air flow sensor or calculated as shown in equation 4.

$$dm_{th}/dt=(A_{th}P_{baro})/(RT_{man})^{1/2}[(2\gamma/(\gamma-1))*((P_{man}/P_{baro})^{2/\gamma}-(P_{man}/P_{baro})^{(\gamma+1)/\gamma}]^{1/2} \quad 4$$

The effective throttle area $A_{th}$ is identified by reference numeral 70 in FIG. 2C and can be calculated as a function of angle θ in FIG. 2B. As described above, this effective throttle area $A_{th}$ can also be selected from a look-up table that contains a plurality of precalculated effective throttle areas stored as a function of associated throttle plate positions. The barometric pressure $P_{baro}$ can be measured directly. The ideal gas constant R is a known constant and the manifold temperature $T_{man}$ can be measured. Manifold pressure $P_{man}$ can be measured directly and the ratio of specific heats for air can be predetermined. Typically, the ratio of specific heats $\gamma$ is a generally constant magnitude, such as 1.40 for air, and is easily determined. Therefore, all of the variables in the right side of equation 4 are known. This allows the calculation of the mass air flow through the throttle body 12. Since the air density $\rho_{chg}$ can be calculated from equation 2, the effective throttle area $A_{th}$ can be determined as described above, and the mass air flow can be calculated from equation 4, the velocity of air travelling through the throttle body 12 can be calculated through the use of equation 3.

One particularly useful application of the present invention is to prevent deleterious wetting of the walls of the throttle body 12 and air intake manifold 14 when the operator of a marine vessel suddenly moves the throttle handle 50 to demand a higher engine speed or higher torque. In systems not implementing the present invention, this sudden movement of the throttle handle 50 will result in a equally sudden movement of the throttle plate 60 to a more open position. In other words, angle $\theta$ will quickly increase This movement of the throttle plate will precede any actual reactive increase in engine speed. As a result, the cylinders of the engine 10 will not use the air as rapidly as the newly increased effective throttle area $A_{th}$, identified by reference numeral 70 in FIG. 2C, would normally allow. As a result of these suddenly increased effective throttle area 70, the velocity of air flowing past the throttle plate 60 will suddenly decrease. This decreased air velocity $V_{th}$ will allow fuel to more readily wet the internal surfaces of the throttle body and nearby surfaces of the air intake manifold 14. These wetted surfaces can result in a degradation of engine operation during transient conditions. Similar problems can occur when the operator suddenly commands a closure of the throttle plate 60.

The present invention avoids these problems by monitoring the air velocity $V_{th}$, as described above in conjunction with equation 3, during transient conditions when the throttle command from the manual throttle handle 50 requests a sudden change in the magnitude of angle $\theta$, the present invention dynamically compares the magnitude of the air velocity $V_{th}$ through the throttle body 12 to assure that it is maintained within acceptable limits. The acceptable limits can be defined in terms of an upper and a lower limit or as a range defined as a function of a preselected desired air velocity magnitude. If the manually controlled throttle handle 50 attempts to change the throttle plate position too rapidly, resulting in a change in air velocity $V_{th}$ to a value outside the acceptable range, the present invention will intercede to amend the demanded throttle position momentarily to allow the throttle plate to be moved at a rate which does not cause the air velocity $V_{th}$ to violate the upper or lower limit.

Figure 6:
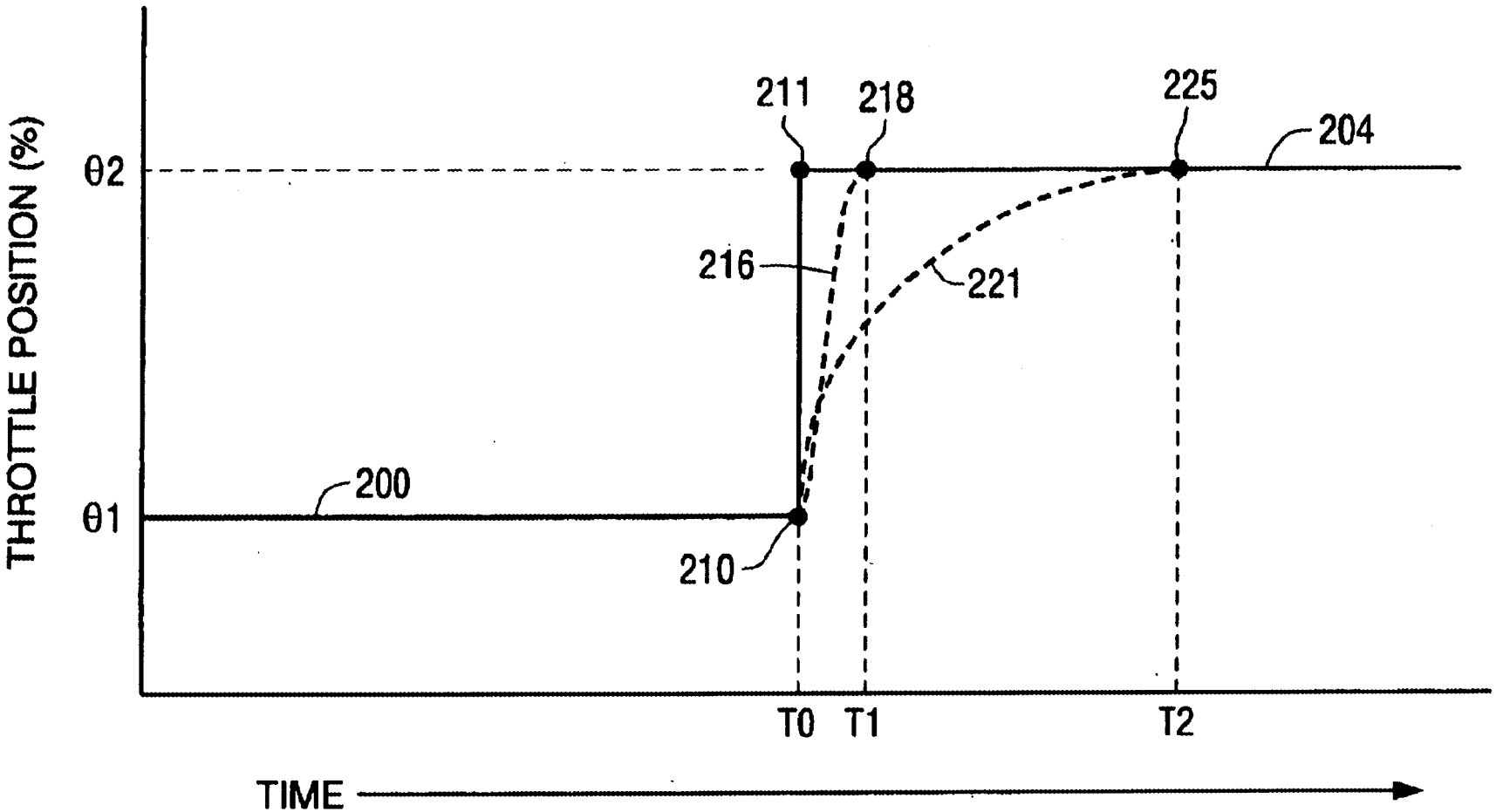
FIG. 6 is a graphical representation of the relationship of a commanded throttle demand signal, the movement of a throttle plate without the present invention, and the movement of the throttle plate as affected by the present invention.

FIG. 6 is a graphical representation showing the effect of the present invention on an incremental and sudden demand for a change in throttle position. The graphical representation in FIG. 6 shows a throttle demand before time T0 which is represented by line 200. At time T0, the requested throttle position is suddenly increased to that which is represented by line 204. On the vertical axis of FIG. 6, these two positions are identified as $\theta$1 and $\theta$2. When the operator suddenly moves the throttle handle 50 to demand a change in the throttle plate position from $\theta$1 to $\theta$2, as represented by points 210 and 211, a control system which does not incorporate the present invention would typically respond in a manner represented by dashed line 216. This would change the throttle position from $\theta$1 to $\theta$2 in the time that elapses from time T0 to time T1. The throttle plate 60 would reach its demanded position of $\theta$2 at point 218 in FIG. 6. It is possible that this type of sudden change, represented by dashed line 216, would result in a sudden decrease in air velocity $V_{th}$ through the throttle body 12 that could result in the increased wetting with fuel of the internal surfaces of the throttle body 12. This, in turn, would result in an improper transient response by the system.

In a control system incorporating the method of the present invention, the engine control unit 20 would respond to the manual throttle demand signal on line 122 by initially providing that demand to the electronic throttle control motor. Immediately, the various parameters described above in conjunction with FIG. 4, would be monitored and the air velocity $V_{th}$ would be determined in the manner described above in conjunction with equations 3 and 4. If the velocity drops below a lower limit, an amended throttle demand would be provided by the present invention in place of the original manually provided throttle command on line 122. This sequence of steps would be repeated continually until the throttle plate 60 reaches a demanded position. As a result, the throttle position would change from $\theta$1 to $\theta$2 along a path such as that represented by dashed line 221 in FIG. 6. At a later time T2, represented by point 225, the throttle plate 60 would reach the commanded position of $\theta$2. However, the speed of movement of the throttle plate 60 is controlled by the present invention to assure that the air velocity $V_{th}$ flowing through the throttle body does not fall below a lower limit. This prevents the excessive wetting of the throttle body and nearby surfaces with fuel as described above. Although not shown in FIG. 6, it should be understood that the present invention would react to a sudden closure of the throttle plate 60 in a similar manner, to prevent the air velocity $V_{th}$ from increasing to an acceptable magnitude as the throttle plate 60 is suddenly closed.

The concept of the present invention controls the movement of a throttle plate within a throttle body as a dual function of both a throttle position command, such as that received on line 122 from the throttle handle 50, and a calculated air velocity parameter, such as the air velocity $V_{th}$ flowing through the throttle body 12. By constantly monitoring air velocity through the throttle body, wetting of the throttle body surfaces with fuel can be prevented and associated deleterious transient operation can be avoided. It should be understood that the present invention operates to maintain the air velocity $V_{th}$ within an acceptable range both during a sudden opening and a sudden closing of the throttle plate 60.

Although the present invention has been described in particular detail and illustrated to show a preferred embodiment, it should be understood that alternative embodiments are also within its scope.

We claim:

1. A method for controlling the operation of an engine, comprising the steps of:

receiving a throttle command signal;

determining a commanded throttle position as a function of said throttle command signal;

determining a mass air flow through a preselected portion of an air intake conduit of said engine;

determining a density of air passing through said preselected portion of an air intake conduit of said engine;

determining an effective area of said preselected portion of an air intake conduit of said engine;

determining an air flow velocity through said preselected portion of an air intake conduit of said engine;

comparing said air flow velocity to an acceptable range of velocities; and providing an amended throttle command signal in response to said air flow velocity not being within said acceptable range of velocities.

2. The method of claim 1, wherein:

said commanded throttle position is a percentage of full travel of a throttle relative to a throttle body.

3. The method of claim 1, wherein:

said mass air flow determining step comprises the step of measuring said mass air flow with a mass air flow sensor.

4. The method of claim 1, wherein:

said mass air flow determining step comprises the step of calculating said mass air flow as a function of barometric pressure, manifold pressure, temperature, and said effective area of said preselected portion of an air intake conduit of said engine.

5. The method of claim 1, wherein:

said air density determining step comprises the steps of measuring a temperature at said preselected portion of an air intake conduit of said engine, measuring a pressure at said preselected portion of an air intake conduit of said engine, and calculating said air density as a function of said pressure and temperature.

6. The method of claim 1, wherein:

said effective area determining step comprises the steps of selecting said effective area from a table of a plurality of magnitudes of said effective area stored as a function of an associated plurality of throttle positions.

7. The method of claim 1, wherein:

said air flow velocity determining step comprises the step of calculating said air flow velocity as a function of said mass air flow through a preselected portion of an air intake conduit of said engine, said density of air passing through said preselected portion of an air intake conduit of said engine, and a temperature of air within an air manifold of said engine.

8. The method of claim 1, wherein:

said throttle command signal receiving step comprised the step of receiving a signal which represents the position of a manually movable throttle control handle.

9. A method for controlling the operation of an engine, comprising the steps of:

receiving a throttle command signal; and causing a throttle plate to move to a position determined as a dual function of said throttle command position and an air velocity through a preselected portion of an air intake conduit of said engine;

wherein said causing step comprises the steps of;

a) determining a commanded throttle position as a function of said throttle command signal;

b) determining a mass air flow through a preselected portion of an air intake conduit of said engine;

c) determining a density of air passing through said preselected portion of an air intake conduit of said engine;

d) determining an effective area of said preselected portion of an air intake conduit of said engine;

e) determining said air flow velocity through said preselected portion of an air intake conduit of said engine;

f) comparing said air flow velocity to an acceptable range of velocities; and g) providing an amended throttle command signal in response to said air flow velocity not being within said acceptable range of velocities.

10. The method of claim 9, wherein:

said throttle command signal receiving step comprised the step of receiving a signal which represents the position of a manually movable throttle control handle.

11. The method of claim 9, wherein:

said commanded throttle position is a percentage of full travel of a throttle relative to a throttle body.

12. The method of claim 9, wherein:

said mass air flow determining step comprises the step of measuring said mass air flow with a mass air flow sensor.

13. The method of claim 9, wherein:

said mass air flow determining step comprises the step of calculating said mass air flow as a function of barometric pressure, manifold pressure, temperature, and said effective area of said preselected portion of an air intake conduit of said engine.

14. The method of claim 9, wherein:

said air density determining step comprises the steps of measuring a temperature at said preselected portion of an air intake conduit of said engine, measuring a pressure at said preselected portion of an air intake conduit of said engine, and calculating said air density as a function of said pressure and temperature.

15. The method of claim 9, wherein:

said effective area determining step comprises the steps of selecting said effective area from a table of a plurality of magnitudes of said effective area stored as a function of an associated plurality of throttle positions.

16. The method of claim 9, wherein:

said air flow velocity determining step comprises the step of calculating said air flow velocity as a function of said mass air flow through a preselected portion of an air intake conduit of said engine, said density of air passing through said preselected portion of an air intake conduit of said engine, and a temperature of air within an air manifold of said engine.

17. The method of claim 9, wherein:

said throttle command signal receiving step comprised the step of receiving a signal which represents the position of a manually movable throttle control handle.

18. A method for controlling the operation of an engine, comprising the steps of:

receiving a throttle command signal;

determining an air flow velocity through said preselected portion of an air intake conduit of said engine; and causing a throttle plate to move to a position determined as a dual function of said throttle command position and said air velocity through a preselected portion of an air intake conduit of said engine;

wherein said throttle command signal receiving step comprises the step of receiving a signal which represents the position of a manually movable throttle control handle;

said causing step comprises the steps of;

a) determining a commanded throttle position as a function of said throttle command signal;

b) determining a mass air flow through a preselected portion of an air intake conduit of said engine;

c) determining a density of air passing through said preselected portion of an air intake conduit of said engine;

d) determining an effective area of said preselected portion of an air intake conduit of said engine;

f) comparing said air flow velocity to an acceptable range of velocities; and g) providing an amended throttle command signal in response to said air flow velocity not being within said acceptable range of velocities.

19. The method of claim 18, wherein:

said commanded throttle position is a percentage of full travel of a throttle relative to a throttle body.

20. The method of claim 19, wherein:

said mass air flow determining step comprises the step of measuring said mass air flow with a mass air flow sensor.

21. The method of claim 20, wherein:

said mass air flow determining step comprises the step of calculating said mass air flow as a function of barometric pressure, manifold pressure, temperature, and said effective area of said preselected portion of an air intake conduit of said engine.

22. The method of claim 21, wherein:

said air density determining step comprises the steps of measuring a temperature at said preselected portion of an air intake conduit of said engine, measuring a pressure at said preselected portion of an air intake conduit of said engine, and calculating said air density as a function of said pressure and temperature.

23. The method of claim 22, wherein:

said effective area determining step comprises the steps of selecting said effective area from a table of a plurality of magnitudes of said effective area stored as a function of an associated plurality of throttle positions.

24. The method of claim 23, wherein:

said air flow velocity determining step comprises the step of calculating said air flow velocity as a function of said mass air flow through a preselected portion of an air intake conduit of said engine, said density of air passing through said preselected portion of an air intake conduit of said engine, and a temperature of air within an air manifold of said engine.

25. The method of claim 24, wherein:

said throttle command signal receiving step comprised the step of receiving a signal which represents the position of a manually movable throttle control handle.

* * * * *